US008753172B1

(12) United States Patent
Aviezer et al.

(10) Patent No.: US 8,753,172 B1
(45) Date of Patent: Jun. 17, 2014

(54) SUPERFINISHING SYSTEMS AND METHODS

(75) Inventors: Shai Aviezer, Moshav Shilat (IL); Sergei Dumenko, Or Akiva (IL); Sergei Stepanidin, Winnipeg (CA); Boris Shamshidov, Or Akiva (IL)

(73) Assignee: Fricso Ltd., Tirat Hakarmel (IL)

( * ) Notice: Subject to any disclaimer, the term of this patent is extended or adjusted under 35 U.S.C. 154(b) by 786 days.

(21) Appl. No.: 12/915,076

(22) Filed: Oct. 29, 2010

Related U.S. Application Data

(60) Provisional application No. 61/256,180, filed on Oct. 29, 2009.

(51) Int. Cl.
*B24B 51/00* (2006.01)

(52) U.S. Cl.
CPC ..... *B24B 51/00* (2013.01)
USPC ..... 451/5; 451/8; 451/11; 451/160

(58) Field of Classification Search
CPC ..... B24B 51/00
USPC ..... 451/5, 8, 11, 158, 159, 160
See application file for complete search history.

(56) References Cited

U.S. PATENT DOCUMENTS 5,984,767 A * 11/1999 Pineau et al. ..... 451/302
6,004,189 A * 12/1999 Phillips ..... 451/49
6,048,257 A * 4/2000 Greenman et al. ..... 451/162
7,785,173 B2 * 8/2010 Klotz ..... 451/11
2007/0010171 A1 * 1/2007 Klotz ..... 451/11

* cited by examiner

*Primary Examiner* — Maurina Rachuba
(74) *Attorney, Agent, or Firm* — Mark M. Friedman

(57) ABSTRACT

A CNC system for effecting a finishing treatment of a surface, including: a mechanical assembly having a mechanical arm, adapted to move within at least two controllable axes of motion; a shoe arrangement, adapted to connect to an end of the arm and having at least one flexible surface finishing pad; and a drive mechanism adapted to drive the arm; a controller; a communication arrangement adapted to deliver communication signals between the controller and the mechanical assembly; and a positioning system providing the controller with positioning information with respect to the mechanical assembly, the system configured whereby the arm is responsive to the controller, the mechanical assembly adapted to urge the working surface against a workpiece surface, whereby a pressure is delivered thereto, the mechanical assembly including a controllable spring arrangement disposed and adapted to contribute to an overall mechanical compliance, normal to the working surface, of the mechanical assembly, the spring arrangement responsive to the controller, and wherein the controller is adapted to control the spring arrangement to maintain the pressure within a pre-determined range, or to constrain the pressure to a set point.

19 Claims, 19 Drawing Sheets

Figure 20B
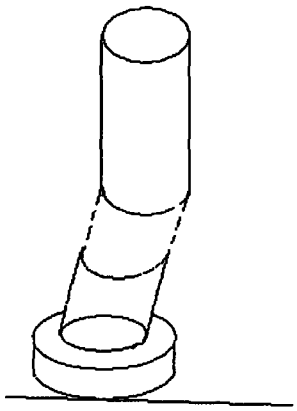
Figure 20
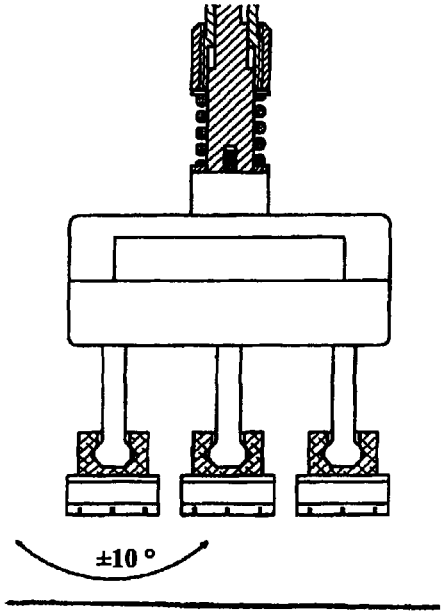
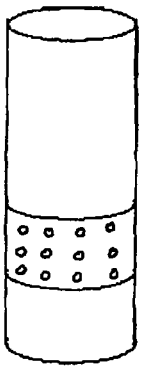
Figure20A

SUPERFINISHING SYSTEMS AND METHODS

This application draws priority from U.S. Provisional Patent Application Ser. No. 61/256,180, filed Oct. 29, 2009, which is incorporated by reference for all purposes as if fully set forth herein.

FIELD AND BACKGROUND OF THE INVENTION

The present invention relates to superfinishing technologies, and more particularly, to superfinishing tools and to superfinishing systems and methods in which superfinishing tools controlled by multiple-axis computer-controlled drive systems such as Computer Numerical Control (CNC) systems.

We have recognized that the ability to perform superfinishing of ground or milled metallic parts in an automatic fashion, and by utilizing available machinery, may be of prime importance in various fields of application. Such fields may include manufacture of injection molding and stamping die equipment, manufacturer of equipment for producing chemicals, pharmaceuticals semiconductors, and thermo-radiative devices, as well as general applications requiring superfinishing of metallic surfaces.

In the various technological fields, the added value may range from pure aesthetics to fully functional needs, such as friction and wear reduction, improved septic characteristics of process equipment, reduced thermal losses, and reduced corrosion.

Although much progress was achieved in recent years through the introduction of ever more sophisticated and accurate milling machines and improved tooling, much of the polishing is still performed by manual operation.

Moreover, when considering the significant costs associated with the production of molds, the polishing operations may contribute significantly to the overall cost.

The present inventors have recognized a need for improved superfinishing technologies.

SUMMARY OF THE INVENTION

According to the teachings of the present invention there is provided a Computer Numerical Control (CNC) system for effecting a finishing treatment of a surface, the system including: (a) a mechanical assembly including: at least one mechanical arm, adapted to move within at least two controllable axes of motion; a shoe arrangement, adapted to connect to an end of the arm and having at least one flexible surface finishing pad, the pad having a working surface having a diameter (D); and a drive mechanism adapted to drive the arm; (b) a controller; (c) a communication arrangement adapted to deliver communication signals between the controller and the mechanical assembly; and (d) a positioning system providing the controller with positioning information with respect to the mechanical assembly, the system configured whereby the arm is responsive to the controller, and wherein the mechanical assembly is adapted to urge the working surface against a workpiece surface, such that a pressure is delivered thereto, and wherein a dimensionless ratio defined by the diameter (D) divided by a length of mechanical deformation ($L_{def}$) of the surface finishing pad, normal to the working surface, fulfills at least one of the following structural criteria:

($D/L_{def}$) falls within a range of 2-120 for the pressure within a range of 0.05-1 bar;

($D/L_{def}$) falls within a range of 4-180 for the pressure within a range of 0.5-2 bar;

($D/L_{def}$) falls within a range of 6-200 for the pressure within a range of 1-3 bar;

($D/L_{def}$) falls within a range of 8-250 for the pressure within a range of 2-6 bar; and ($D/L_{def}$) falls within a range of 12-450 for the pressure within a range of 3-20 bar.

According to further features in the described preferred embodiments, the shoe arrangement includes a finishing tool having at least one spring arrangement, the spring arrangement disposed and adapted to contribute to an overall mechanical compliance of the assembly, normal to the working surface.

According to still further features in the described preferred embodiments, the controller is adapted to control an overall mechanical compliance to maintain the pressure within a pre-determined range, or to constrain the pressure to a set point.

According to another aspect of the present invention there is provided a Computer Numerical Control (CNC) system for effecting a finishing treatment of a surface, the system including: (a) a mechanical assembly including: at least one mechanical arm, adapted to move within at least two controllable axes of motion; a shoe arrangement, adapted to connect to an end of the arm and having at least one flexible surface finishing pad; and a drive mechanism adapted to drive the arm; (b) a controller; (c) a communication arrangement adapted to deliver communication signals between the controller and the mechanical assembly; and (d) a positioning system providing the controller with positioning information with respect to the mechanical assembly, the system configured whereby the arm is responsive to the controller, the mechanical assembly adapted to urge the working surface against a workpiece surface, whereby a pressure is delivered thereto, the mechanical assembly including at least one controllable spring arrangement disposed and adapted to contribute to an overall mechanical compliance, normal to the working surface, of the mechanical assembly, the spring arrangement responsive to the controller, and wherein the controller is adapted to control the spring arrangement to maintain the pressure within a pre-determined range, or to constrain the pressure to a set point.

According to another aspect of the present invention there is provided a mechanical finishing device adapted to connect to, and be activated by, a Computer Numerical Control (CNC) system, the finishing device including: a shoe arrangement, adapted to connect to the mechanical arm and having at least one flexible surface finishing pad; the shoe arrangement adapted whereby, when attached to the arm and with the CNC system in operating mode, the working surface is urged against the workpiece surface, whereby a pressure is delivered thereto, wherein the shoe arrangement includes at least one spring arrangement disposed and adapted to contribute to the overall mechanical compliance, normal to the working surface, of the shoe arrangement.

According to still further features in the described preferred embodiments, the spring arrangement is adapted to be responsive to the controller.

According to still further features in the described preferred embodiments, the CNC system is a portable system.

According to still further features in the described preferred embodiments, the shoe arrangement includes a compressible shaft, adapted to contribute at least 25%, at least 35%, or at least 50% of an overall mechanical compliance of the assembly, normal to the working surface.

According to still further features in the described preferred embodiments, a ratio of a contribution of the shaft to the compliance to a contribution of the finishing pad to an overall mechanical compliance of the assembly, normal to the working surface, is at least 0.33, at least 1, or at least 10.

According to still further features in the described preferred embodiments, the ratio is less than 200, less than 50, or less than 20.

According to still further features in the described preferred embodiments, the finishing pad includes at least one groove disposed in the working surface, the at least one groove adapted, whereby, during a finishing operation on the workpiece surface, an abrasive paste disposed on the workpiece surface, around the finishing pad, is delivered, via the at least one groove, to an active contacting surface of the working surface.

According to still further features in the described preferred embodiments, the grooves divide the working surface into a plurality of segments.

According to still further features in the described preferred embodiments, the shoe arrangement includes a support layer adapted to support the pad, the support layer having a flexibility exceeding a flexibility of the pad.

According to still further features in the described preferred embodiments, the finishing pad includes at least one groove disposed in the working surface, the shoe arrangement includes a support layer adapted to support the pad, and the at least one groove is disposed passes through the pad and at least partway through the support layer.

According to still further features in the described preferred embodiments, the shoe arrangement includes a holder adapted to hold the pad.

According to still further features in the described preferred embodiments, the controller is adapted to control an overall mechanical compliance of the assembly.

According to still further features in the described preferred embodiments, the spring arrangement is disposed and adapted to contribute to an overall mechanical compliance of the assembly, and is responsive to the controller.

According to still further features in the described preferred embodiments, the controller is adapted to control the spring arrangement to maintain the pressure within a predetermined range, or to constrain the pressure to a set point.

According to still further features in the described preferred embodiments, the controller is adapted to control the overall mechanical compliance by control of an internal pressure within the mechanical assembly.

According to still further features in the described preferred embodiments, the internal pressure is a pneumatic pressure or a hydraulic pressure.

According to still further features in the described preferred embodiments, the working surface of the finishing tool is a polymeric working surface.

According to still further features in the described preferred embodiments, the at least one mechanical arm is a plurality of mechanical arms, and the drive mechanism is adapted to drive the plurality of arms.

According to still further features in the described preferred embodiments, the drive mechanism includes a main rotating shaft adapted to rotate the plurality of mechanical arms.

According to another aspect of the present invention there is provided a mechanical finishing method, substantially as described herein, the method comprising any feature described, either individually or in combination with any feature, in any configuration.

BRIEF DESCRIPTION OF THE DRAWINGS

The invention is herein described, by way of example only, with reference to the accompanying drawings. With specific reference now to the drawings in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice. Throughout the drawings, like-referenced characters are used to designate like elements.

In the drawings:

FIGS. 9-11 show, in exemplary fashion, cross-sectional views of a finishing shoe secured to a shaft, wherein FIGS. 9 and 10 show a spring arrangement having a mechanical spring, and wherein FIG. 11 shows a spring arrangement in which a piston-based holder enables mechanical compliance substantially along the shaft, and substantially normal to the working surface of the pad;

FIGS. 16-20 show partially side, partially cross-sectional views, various inventive mechanical assemblies having a main rotating shaft, and a plurality of rotating secondary shafts, each of the secondary shafts having a finishing tool disposed on a bottom end;

FIG. 20A provides a perspective view of a flexible joint of a secondary shaft such as any of the secondary shafts provided in FIGS. 16-20;

FIG. 20B provides a perspective view of the flexible joint of FIG. 20A, the joint shown in a bent position;

DESCRIPTION OF THE PREFERRED EMBODIMENTS

Figure 1A:
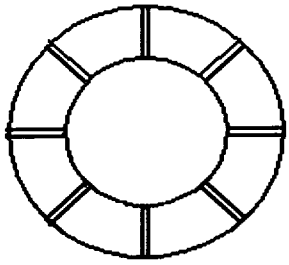
FIG. 1A provides a bottom view of one embodiment of the finishing tool or pad of the present invention.

The invention is herein described, by way of example only, with reference to the accompanying drawings. With specific reference now to the drawings in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, the drawings may be largely schematic; no attempt is made to show structural details of the invention in more detail than is necessary for a fundamental understanding of the invention, the description taken with the drawings making apparent to those skilled in the art how the several forms of the invention may be embodied in practice. It will also be apparent to those skilled in the art that the invention may be structured, practiced or carried out in various ways.

Thus, it is to be understood that the invention is not limited in its application to the details of construction and the arrangement of the components set forth in the following description or illustrated in the drawings. Also, it is to be understood that the phraseology and terminology employed herein is for the purpose of description and should not be regarded as limiting.

The principles and operation of device and method of the present invention may be better understood with reference to the drawings and the accompanying description.

Figure 1B:
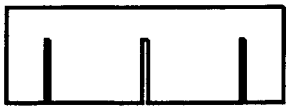
FIG. 1B provides a bottom view of the finishing pad of FIG. 1A.

Referring now to the drawings, FIG. 1A provides a bottom view of one embodiment of the finishing tool or pad of the present invention, in which grooves may divide the working surface into a plurality of segments. The grooves may serve as a reservoir adapted to facilitate the introduction of particles between a particular segment and the workpiece surface disposed opposite thereto. From a mechanical standpoint, each of the segments may be partially, largely or substantially independent from one or more adjacent segment, as well as from more distant segments. Typically, the pad is annular-shaped. The grooves may be generally perpendicular to the outer circumference of the pad, and may divide the active surface of the pad into wedge-like segments. A side view is provided in FIG. 1B.

The bottom view provided in FIG. 1A may also represent the bottom views of additional embodiments of the invention, inter alia those provided in FIGS. 2-5.

Such a finishing tool may typically be used as a lapping tool. The finishing tool may be adapted with a pad or unit containing a fixed abrasive.

Figure 2:
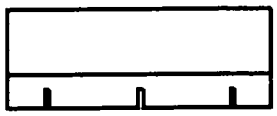
FIG. 2 provides a side view of the finishing pad attached to a flexible support layer.

FIG. 2 provides a side view of another embodiment of the finishing tool or pad of the present invention. The active layer of the pad may be supported by a support layer. The grooves may extend at least partway through the active layer.

In various applications, the support layer may exhibit greater flexibility than that of the active layer. In such applications, the Young's modulus of the support layer may be within a range of 5 megapascals (MPa) to 300 MPa, and often, within a range of 20 MPa to 150 MPa.

In various applications, the support layer may be significantly more rigid, having a Vickers hardness of 50 to 1500. Notwithstanding the above the incorporation of multiple flexible layers and their structural arrangement may provide an additional degree of flexibility and compliance to the tool shoe.

Figure 3:
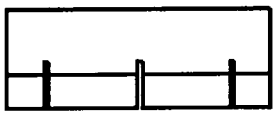
FIG. 3 provides a side view of another inventive embodiment in which the grooves of the pad extend at least partway through the support layer, via the bottom surface thereof.

FIG. 3 provides a side view of another embodiment of the finishing tool or pad of the present invention, in which the active layer of the pad may be supported by a support layer, in a similar fashion to the pad shown in FIG. 2. However, it may be advantageous to extend the grooves at least partway through the support layer, via the bottom surface thereof, as shown in FIG. 3.

Figure 4:
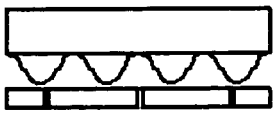
FIG. 4 provides a side view of another inventive embodiment in which the support layer includes a substantially rigid base, and at least one spring element or assembly connected to the base.

FIG. 4 provides a side view of another embodiment of the inventive, supported finishing tool, in which the base or support layer may include a substantially rigid base, and at least one spring element or assembly connected to the base, the spring element typically facing a top surface (distal to the working surface of the pad) of the lapping pad.

This structure may be particularly advantageous for use in various applications requiring a relatively high mechanical compliance (high deformation at low contact pressures) or for low surface contact pressure or applications utilizing or requiring tool materials in which the hardness of the active layer exceeds 90 on the Shore D scale.

Figure 5:
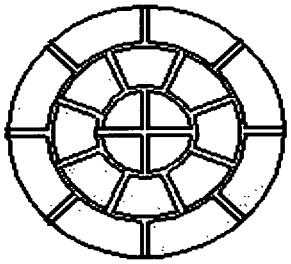
FIG. 5 provides a bottom view of another embodiment of the finishing pad of the present invention.

FIG. 5 provides a bottom view of another embodiment of the finishing tool or pad of the present invention, in which, as in FIG. 1A, grooves may divide the working surface into a plurality of segments. However, instead of having a circular, hollow region within the annular pad, as in FIG. 1A, that region is at least partially filled by at least one additional circular or annular pad area. In the exemplary embodiment provided in FIG. 5, the pad surface is substantially filled, to enable utilization of the entire surface for contacting the workpiece surface. In between the outer annular region and the inner region is disposed a groove fluidly connecting the grooves from the outer annular region and the grooves from the inner region, to enable abrasive paste from around the outer annular region to work its way into the grooves of the inner region, and onto the active surface of that region.

The grooves of the inner and outer region may be substantially radial i.e., perpendicular to the outer surface of the finishing tool or pad. However, in cases in which a high rotational speed may be needed, the grooves may have a different shape to allow better introduction of paste to the lapping surface or to allow abrasive debris removal in the case of grinding processes.

Figure 6A:
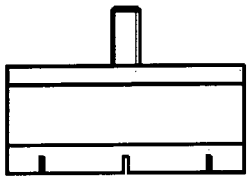
FIG. 6A provides a side view of an exemplary finishing shoe of the present invention.

FIG. 6A provides a side view of an exemplary finishing shoe of the present invention. The shoe may include a housing or holder adapted to hold finishing tools, including any of the finishing tools described hereinabove.

Introduction of grooves into the active lapping layer that are not dividing it into separate segments on the entire depth of the layer may help to improve lapping paste availability into the lapping segment without reducing its ability to stand very high contact pressures (up to 2 MPa) needed in some cases.

The holder may be associated with a connecting element or assembly such as a plate having a connecting bolt pin (threaded or unthreaded) or another connecting mechanism allowing the securing of the shoe to the device.

Figure 6B:
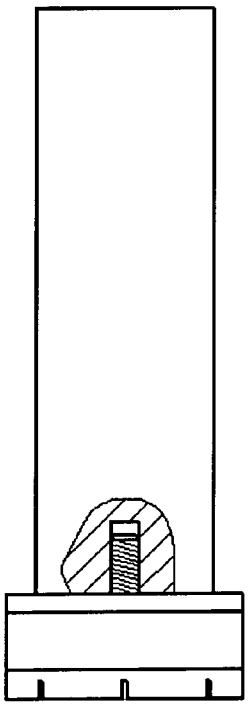
FIG. 6B provides a side, partially cut-open view of the exemplary finishing shoe of FIG. 6A, secured to a shaft or mechanical arm.

FIG. 6B provides a side, partially cut-open view of the exemplary finishing shoe of FIG. 6A, secured to a shaft, such that rotation of the shaft effects rotation of the finishing shoe.

Figure 7A:
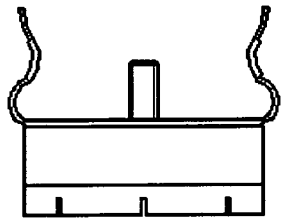
FIG. 7A provides a side view of another exemplary finishing shoe according to the present invention.
Figure 7B:
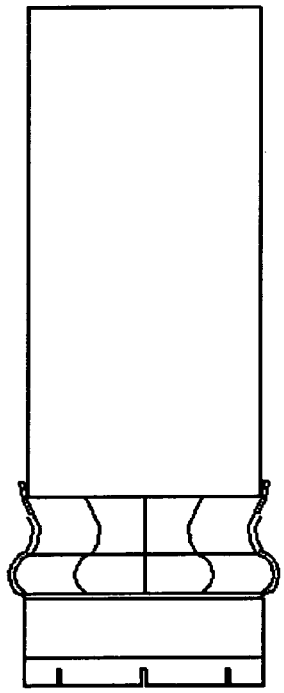
FIG. 7B provides a side view of the exemplary finishing shoe of FIG. 7A, secured to a shaft or mechanical arm by a connecting arrangement.

FIG. 7A provides a side view of another exemplary finishing shoe of the present invention. The shoe may include an additional connecting element or assembly having an elastic or spring-like wall dimensioned to receive a shaft, and to exert a pressure (in this example, a radially-inward pressure) to secure the shoe in place against the shaft, as shown in the side view provided in FIG. 7B.

Figure 8A:
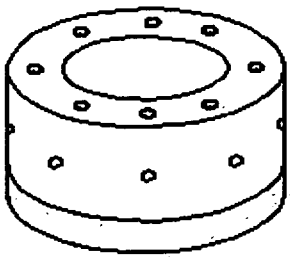
FIG. 8A provides a perspective view of a support layer attached to a finishing pad, the support layer having a geometrical frame made of an elastomer or polymeric material containing a plurality of voids.

A tailored mechanical compliance for the lapping shoe may be achieved by utilizing a support layer having a geometrical frame made of an elastomer or polymeric material containing a plurality of voids (FIG. 8A). The mechanical compliance of the structure may be increased by increasing the void fraction within the support layer.

Consequently, the response to a force exerted on the surface may be more complex than the response anticipated from Hooke's Law.

Figure 8B:
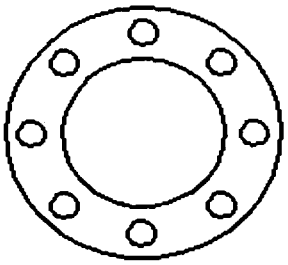
FIG. 8B provides a top view of the support layer shown in FIG. 8A.

A top view of the support layer is provided in FIG. 8B.

Figure 9:
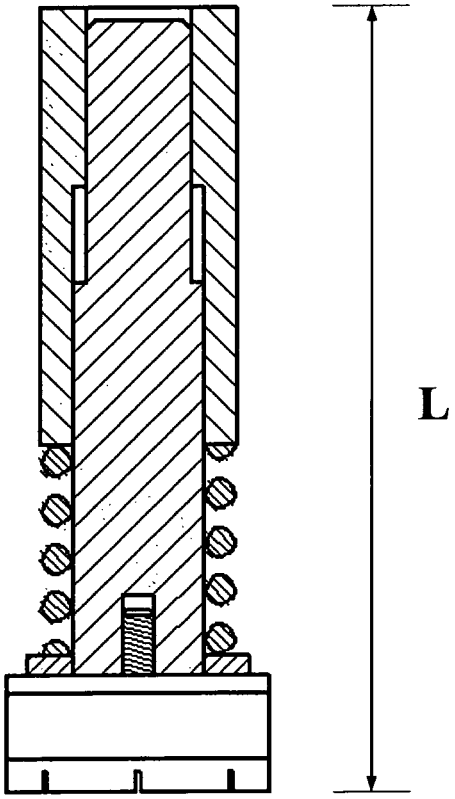
Figure 10:
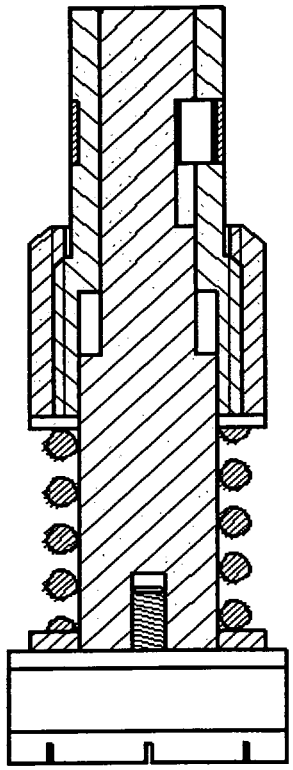
Figure 11:
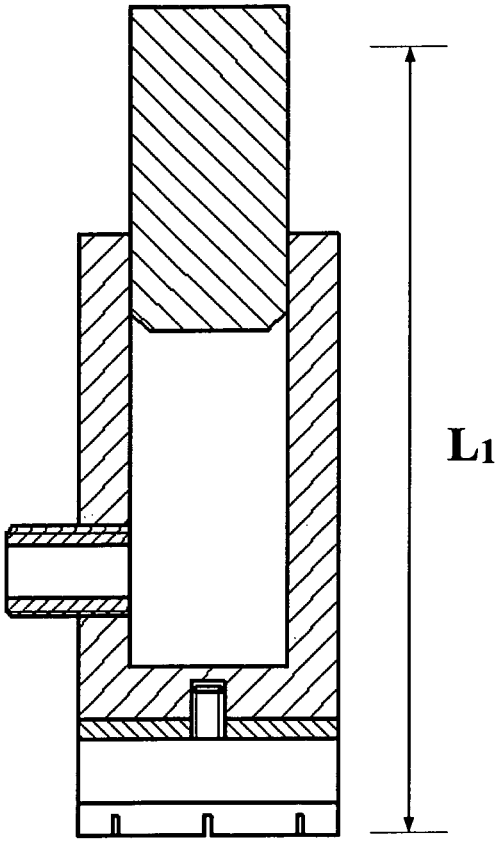

FIGS. 9-11 show, in an exemplary fashion, the finishing shoe of FIG. 6A, secured to a shaft substantially as shown in FIG. 6B. Around this shaft may be disposed an outer shaft that may be generally cylindrical, and may have a cover or top end that is disposed above the inner shaft connected to the shoe. The outer shaft may further be equipped with a compressive element or assembly enabling extension and/or contraction of the variable-length finishing arm or arrangement, to obtain a length L. In FIGS. 9 and 10, the compressive element, spring arrangement, or assembly includes a mechanical spring such as a coil spring. In FIG. 11, the holder is a piston-based holder, and the variable-length finishing arm or arrangement has a length $L_1$. The shaft may include at least two components that move or slide in lengthwise fashion with respect to one another, whereby length $L_1$ may be increased and/or decreased relative to an initial or nominal length of the finishing arm or arrangement. Length $L_1$ may be controlled by adjusting the gas pressure or the hydraulic pressure within the chamber housing the piston.

Figure 12:
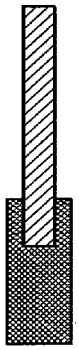
FIGS. 12-14 provide cross-sectional views of respective finishing shoes, each attached to a shaft.
Figure 13:
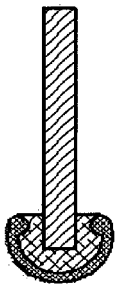
Figure 14:
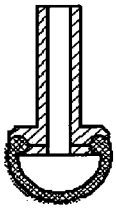

FIGS. 12-14 show, in an exemplary fashion, various finishing tools, each attached to a shaft. The shaft may be inserted into a multiple-axis computer-controlled drive system, which will be described in further detail hereinbelow.

Figure 15:
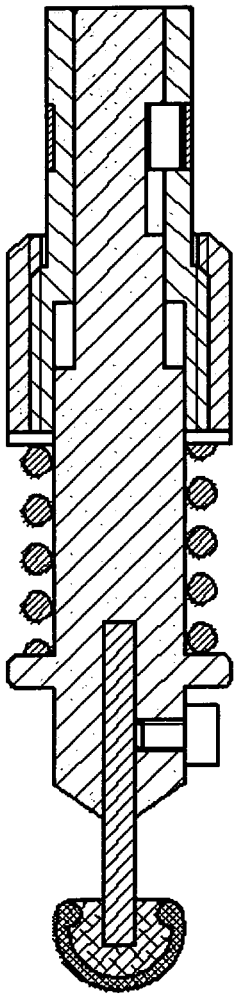
FIG. 15 provides a cross-sectional view of an inventive shoe arrangement including the finishing shoe of FIG. 13, the shoe being secured within an outer shaft.

FIG. 15 provides, in an exemplary fashion, the finishing tool of FIG. 13, secured within an outer shaft that may be generally cylindrical. The outer shaft may further be equipped with a compressive element or assembly enabling extension and/or contraction of the variable-length finishing arm or arrangement. As shown in FIG. 15, the compressive assembly includes a mechanical spring such as a coil spring, and a base or support for the spring.

The variable-length finishing arm or arrangement may further include a pre-loading arrangement operative to pre-load the mechanical spring. In FIG. 15, the pre-loading arrangement includes a threaded component, disposed around the shaft, and adapted to be rotated with respect to the shaft to compress the spring whereby a fixed, pre-determined pre-loading position may be attained.

FIGS. 16-20 show, in an exemplary fashion, various finishing tool systems that may include a main rotating shaft, a motor, bearings disposed in a housing, and a plurality of rotating secondary shafts, each having a finishing tool disposed on a bottom end, distal to the main rotating shaft.

In each of the devices provided in FIGS. 16-20, the entire device may turn around the main shaft, while each of the plurality of finishing shoes rotates along with the secondary shaft as well as with the main shaft. All rotating speeds can be modulated by design of a gear box, transfer ratios, and an internal structure or additional motors attached to, or embedded in, the device.

Figure 16:
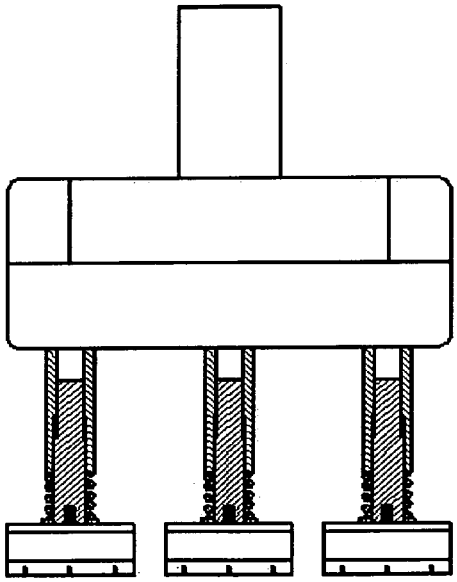

In FIG. 16, the introduction of a spring compression mechanism on the secondary shafts may improve the ability of the device to perform well during the treatment of curved workpiece surfaces.

Figure 17:
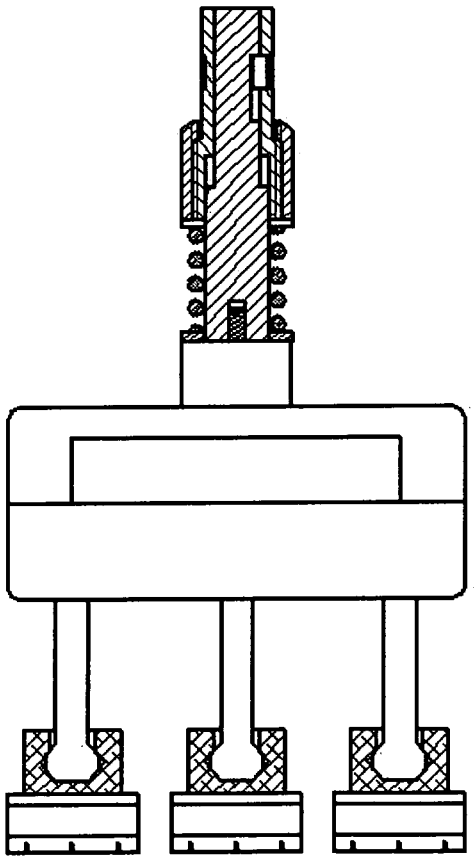
Figure 18:
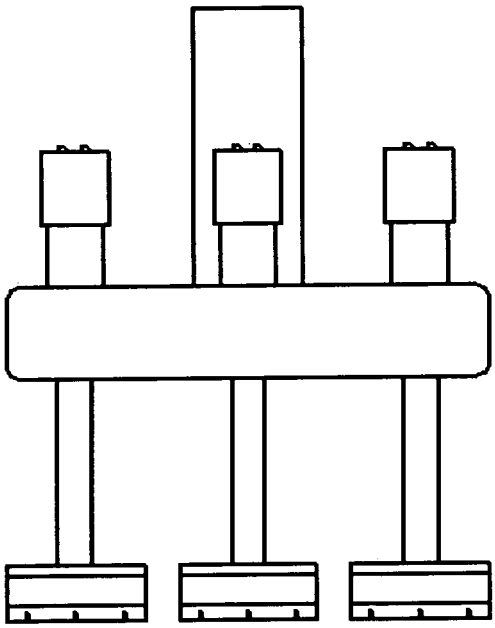
Figure 19:
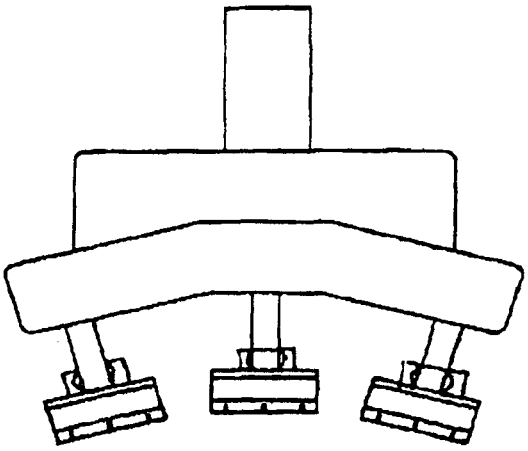

In order to reduce the dependence of the contact pressure in actual position of the tool, a spring (or piston) mechanism may be attached to a planetary (dividing) gear box, as shown in schematic fashion in FIG. 17. Additional flexibility with respect to the workpiece surface may be obtained by flexibly connecting each finishing shoe to the respective secondary shaft.

The implementation of the co-rotation of the secondary shafts and the entire device may also be achieved by means of a dedicated electric motor for each of the secondary shafts. Each electric motor may be connected by a rotating electrical connector to the main control system (not shown). This arrangement, shown in schematic fashion in FIG. 18, may enable different, variable, independently controlled rotation speeds for each secondary shaft.

Such independent control may improve the overall uniformity of the treated surface, for example, by reducing or substantially eliminating various periodic effects.

Alternatively or additionally, each secondary shaft may be equipped with a different lapping shoe.

Moreover, in order to improve the ability of the device to perform well when finishing curved surfaces, a housing having the axes positioned in a non-parallel manner may be used. Such an arrangement may better position the tool shoes against the curved surface. Typically, the relative angle of the shafts can range from −45 to +45 degrees (i.e., concave to convex). An exemplary perspective view of such a device is provided in FIG. 19.

With reference now to FIGS. 20, 20A, and 20B, the adaptability of the position of tool shoes to a required position over a curved surface may be improved by utilizing a variety of flexible joints. Such flexible joints are adapted to enable a varying angle between the primary direction of the secondary shafts and the average plane beneath each tool shoe surface. Such mechanisms may include, by way of example, flexible cast joints, springs, rotationally restrained ball joints, crimped cables and other arrangements that will be apparent to those skilled in the art.

FIG. 20 describes a device having a housing including multiple secondary shafts, adapted whereby the entire device turns with the main shaft, while each of the plurality of finishing shoes rotates along with the secondary shaft as well as with the main shaft. A component characterized as rotationally disturbed ball joint may be installed on the distal end of each secondary shaft, proximal to the tool shoe, allowing the transfer of torque to the tool shoe and allowing for each shoe allocation on the treated surface (FIG. 20B) of the work piece, even on curved surfaces during device rotation.

Figure 21:
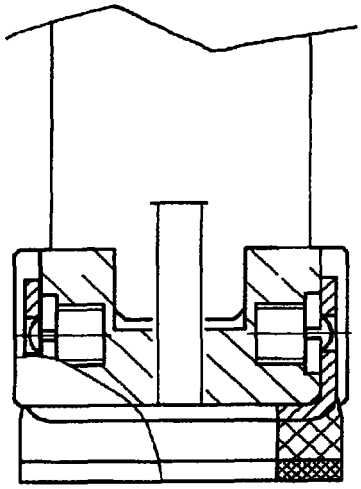
FIG. 21 shows a schematic cross-section of an assembled shoe over shaft, teaching the usage of spring-based balls.
Figure 21A:
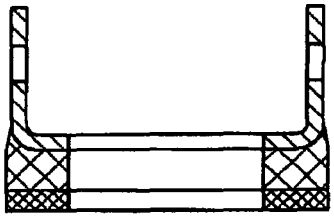
FIG. 21A provides a cross-section of the shoe in which a rigid support, a support layer, and an active layer for treatment of the work piece surface are presented.
Figure 21B:
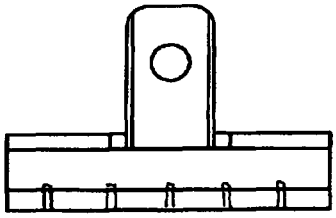
FIG. 21B provides an additional schematic cross-section of the shoe.

FIGS. 21, 21A, and 21B provide another mechanism employing a spring-based lock of the tool shoe over the secondary shafts. FIG. 21 shows a schematic cross-section of an assembled shoe over shaft, teaching the usage of spring-based balls to lock the shoe over the shaft. Similar mechanical arrangements to lock the shoe over the shaft may be readily apparent to those of ordinary skill in the art. FIG. 21A provides a cross-section of the shoe in which a rigid support, a support layer, and an active layer for treatment of the work piece surface are presented. FIG. 21B provides an additional schematic cross-section of the shoe.

Figure 22:
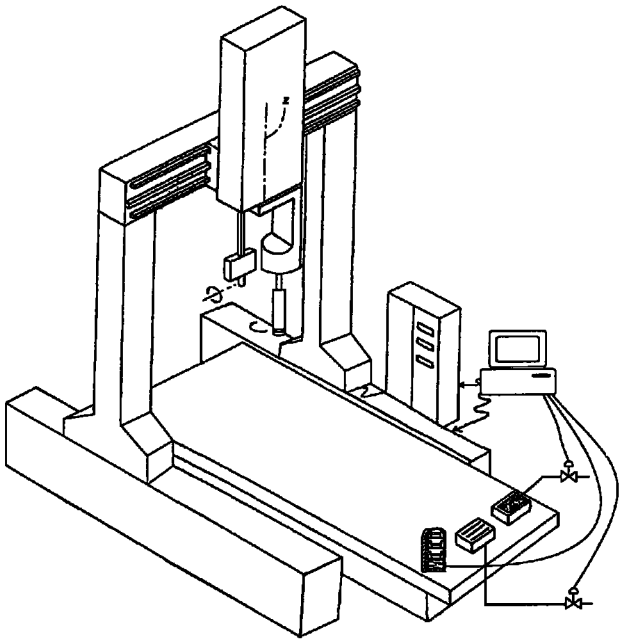
FIG. 22 provides a perspective view of a CNC system equipped with a mechanical assembly including a shoe arrangement having a shoe, according to another aspect of the present invention.

FIG. 22 describes a complete CNC system equipped with a surface treatment device having a shoe arrangement having one or more treatment shoes (e.g., for lapping or grinding) and several additional devices installed on the machine to improve the automation of the surface treatment process. In FIG. 22, the exemplary system includes: a shoe arrangement having a finishing tool or pad (1); a positioning system including a detection device (2) having a digital camera and a laser scanner connected to the control system (3) via a communication arrangement such as electrical communication lines; a drive mechanism (4), typically including a plurality of motors, for positioning the mechanical arm (12) and for rotating the shaft of the mechanical arm (12); an abrasive perforated or porous plate (5) preferably equipped with a vacuum line connected by means of control valve to the control system; and an air knife device (6) for cleaning the tool after reconditioning it over the abrasive plate (5).

The air knife device may be connected to the control system through a control valve that regulates airflow. In order to eliminate the need for manual replacement of the lapping shoe/finishing pad after the active layer is consumed, a lapping shoe magazine (7) and removal device (8) may be associated with the CNC system. Devices (7) & (8) may be connected to the main control system.

Figure 23A:
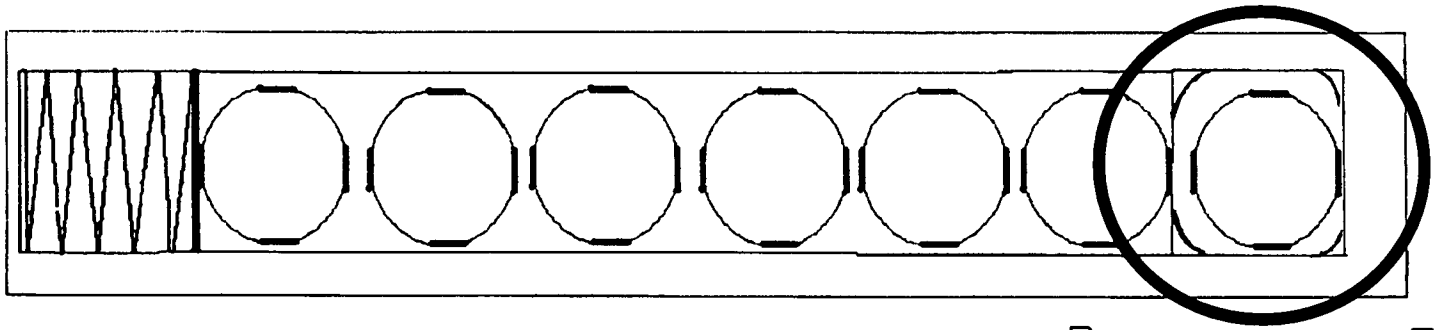
FIGS. 23A and 23B show top and cross-sectional views, respectively, of an inventive magazine suitable for storing a plurality of tool shoes or finishing pads.
Figure 23B:
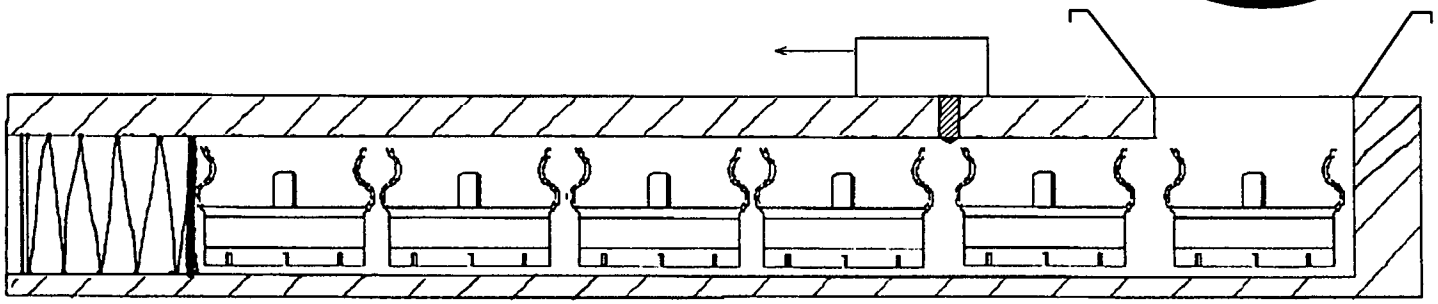

FIGS. 23A and 23B present one exemplary embodiment of a magazine suitable for storing at least two, at least 6, and typically, at least 10 tool shoes or finishing pads. In the magazine, tool shoes may be placed in a row in a housing (such as a rectangular container) having an opening at one end. Around the opening, a small, cone-shaped funnel may be disposed to target the secondary shafts of any of the exemplary devices provided in FIGS. 16-20. The tool shoes may be constantly urged towards the opening by a spring located on the opposite end of the magazine.

Figure 24:
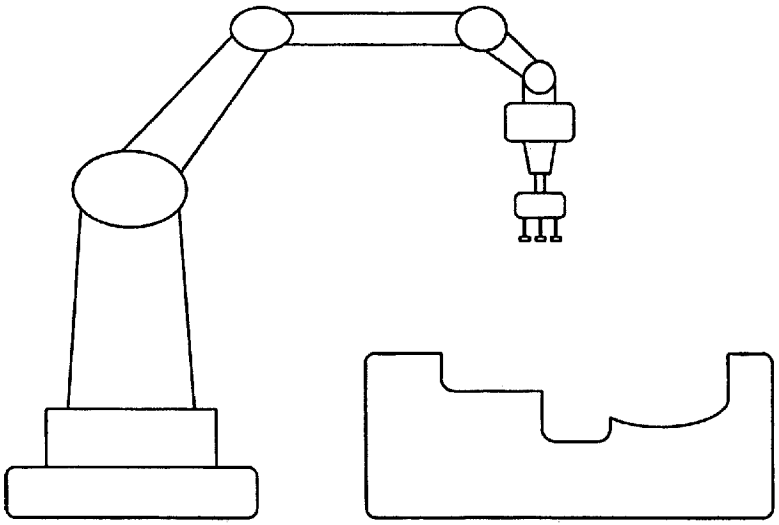
FIG. 24 presents an exemplary embodiment of a multiple-axis computer-controlled drive system adapted to control superfinishing tools, in accordance with the present invention.

FIG. 24 presents one exemplary embodiment of a multiple-axis computer-controlled drive system adapted to control superfinishing tools, in accordance with the present invention. The system is disposed in proximity to a workpiece having complex contouring.

Principle of Operation:

The ability to transform a conventional CNC system or machine from a solely position-controlled system into a system in which the applied forces over the workpiece are also controlled, may be achieved by various mechanisms presented in the figures provided herein.

As the CNC system is fed with the tool dimensions prior to the actual processing in order to process the workpiece to the desired finish, the force that is applied over the surface of the workpiece during processing may be varied and controlled by artificially manipulating the dimensions (typically length alone) of the tool fed into the CNC compared to the actual dimensions thereof. In one exemplary embodiment, this artificial manipulation may be effected by controlling a length of a spring-based mechanism to attain a new degree of control in applying a force of the tool along the surface of the workpiece.

The invention goes beyond this mechanism and is meant to include various mechanisms presented or combinations thereof in a single device. Such mechanisms may include piston-based shafts utilizing either a compressible or a non-compressible fluid. All pressure inputs for such systems may be position-dependent and exist in various commercially available CNC systems. The inventive spring-based systems and the like are further unique in that they obviate the need for an external actuation system.

The implementation of such spring-based systems is further unique in that all of the control of the CNC system (or other multiple-axis computer-controlled drive systems) may be performed solely by a supra-system that alters the tool dimension along the finishing path thereof, if the predicted area of the contact surface is reduced below a certain, typically pre-determined level.

Lapping Operation:

The basic lapping operation is a result of the applied force over an abrasive particle by the polymeric tool. The force is applied in two directions—orthogonal and lateral, where the latter creates the movement of the particle with respect to the workpiece.

According to the specific mechanical properties of the polymeric lapping tool, the particle interaction with the workpiece may be regulated in a manner that the overall local stresses are governed by the polymer counter-response to the interaction of the particle with the surface.

In sharp contrast to fixed-abrasive processes, the non-restricted nature of the interaction between the particle and the surface enables the abrasive particle to rotate in multiple directions as the lapping process proceeds. In addition, due to the high resistance of the polymer to wear, the eroded abrasive particles may still be mobilized by the polymeric lapping tool. Thus, an ever increasing superfinishing efficiency is achieved by the combination of multiple processing steps (in conventional superfinishing lapping processes) into a single processing step. In this single processing step, improvements in surface roughness may largely parallel size reduction of the cutting edges of the abrasive particles, whereby ever finer abrasive treatment is achieved.

In order to tailor the fine processing parameters that enable the desired operation, the device may be adapted to address the parameters listed below:

1. Regulated contact pressure—both average and maximal in the device.
2. Multiple speeds within a single lapping device.
3. Relatively free refreshment of abrasive paste between the lapping tool surface and the workpiece surface.
4. Flexibility of the lapping tool surface in order to align the two planes of the lapping surface and workpiece in case the workpiece is not completely planar. The flexibility and adaptability of the mechanical device may be realized by means of multiple degrees of freedom in the device, provided, by way of example, by slip-shafts, springs, and flexible support for the lapping material within the lapping shoes.

The devices and methods of the present invention may be applied in a wide variety of applications, including, but not limited to, super-finishing processes, and high-speed processing in Computer Numerical Control (CNC) machines

EXAMPLES

Reference is now made to the following examples, which together with the above descriptions, illustrate the invention in a non-limiting fashion. Typical results of the superfinishing devices and methods of the present invention are provided below in Examples 1-9. In Examples 1-9, the superfinishing tools were controlled by multiple-axis computer-controlled drive systems. In Examples 7-9, the multiple-axis computer-controlled drive system used had three secondary, independently rotating shafts in addition to the main rotating shaft (similar to FIGS. 16-18).

| | Work piece properties | | | Before treatment | | | | After treatment | | | |
|---|---|---|---|---|---|---|---|---|---|---|---|
| Sample | Material | Hardness HRC | Tool Size mm | Ra µm | Ry µm | RΔq | Rpk µm | Ra µm | Ry µm | RΔq | Rpk µm |
| | | | | EXAMPLES 1-6 | | | | | | | |
| #1 | W.NR 1.2379(SAE D2) | 64 | DØ21 dØ12.5 | 0.148 | 1.53 | 0.07 | 0.04 | 0.024 | 0.26 | 0.01 | 0.02 |
| #2 | W.NR 1.2379(SAE D2) | 64 | DØ41 dØ23 | 0.149 | 1.55 | 0.04 | 0.16 | 0.029 | 0.47 | 0.01 | 0.05 |
| #3 | W.NR 1.2379(SAE D2) | 64 | DØ41 dØ23 | 0.113 | 0.101 | 0.04 | 0.11 | 0.024 | 0.33 | 0.01 | 0.03 |
| #4 | W.NR 1.2083 | 58 | DØ12 dØ6 | 0.104 | 1.21 | 0.04 | 0.09 | 0.041 | 0.65 | 0.02 | 0.07 |
| #5 | W.NR 1.2083 | 58 | DØ12 dØ6 | 0.104 | 1.21 | 0.04 | 0.09 | 0.045 | 0.63 | 0.02 | 0.03 |
| #6 | W.NR 1.2083 | 31 | DØ31 dØ18 | 0.167 | 1.57 | 0.05 | 0.15 | 0.035 | 0.33 | 0.02 | 0.07 |
| | | | | EXAMPLES 7-9 | | | | | | | |
| #7 | W.NR 1.2344 | 54 | 3 × (DØ21 dØ12.5) | 0.224 | 2.08 | 0.05 | 0.28 | 0.039 | 0.45 | 0.02 | 0.03 |
| #8 | Stainless steel 303 | 21.5 | 3 × (DØ31 dØ18) | 0.999 | 6.59 | 0.12 | 0.69 | 0.029 | 0.27 | 0.01 | 0.04 |
| #9 | Cast Iron GG25 | 21.5 | 3 × (DØ31 dØ18) | 0.680 | 5.9 | 0.07 | 0.69 | 0.150 | 3.7 | 0.02 | 0.1 |

A description of CNC machinery is provided in U.S. Pat. No. 6,061,865, which is incorporated by reference for all purposes as if fully set forth herein.

Throughout this disclosure, various aspects of this invention can be presented in a range format. It should be understood that the description in range format is merely for convenience and brevity and should not be construed as an inflexible limitation on the scope of the invention. Accordingly, the description of a range should be considered to have specifically disclosed all the possible subranges as well as individual numerical values within that range. For example, description of a range such as from 1 to 10 should be considered to have specifically disclosed subranges such as from 1 to 2, from 1 to 5, from 1 to 8, from 3 to 4, from 3 to 8, from 3 to 10, etc., as well as individual numbers within that range, for example, 1, 2, 3, 4, 5, 6, 7, 8, 9, and 10. This applies regardless of the breadth of the range.

Similarly, the terms "at least", "exceeds", and the like, followed by a number (including a percent or fraction), should be considered to have specifically disclosed all the possible subranges above that number, as well as individual numerical values above that number. For example, the term "at least 75" should be considered to have specifically disclosed subranges such as 80 and above, 90 and above, etc, as well as individual numbers such as 85 and 95.

Similarly, the terms "less than", "below", and the like, followed by a number (including a percent, fraction, or ratio such as a weight ratio), should be considered to have specifically disclosed all the possible subranges below that number, as well as individual numerical values below that number. For example, the term "below 75%" should be considered to have specifically disclosed subranges such as 70% and below, 60% and below, etc, as well as individual numbers such as 65% and 50%.

Whenever a numerical range is indicated herein, the range is meant to include any cited numeral (fractional or integral) within the indicated range. The phrase "ranging/ranges between" a first number and a second number and "within a range of" a first number to a second number, and the like, are used herein interchangeably and are meant to include the first and second indicated numbers and all the fractional and integral numerals therebetween.

It will be appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable sub-combination.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims. All publications, patents and patent applications mentioned in this specification, including U.S. Pat. Nos. 7,134,939, 7,578,724, 7,578,728, 7,744,444, and 7,766,727, all to Fricso Ltd., are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention.

What is claimed is:

1. A Computer Numerical Control (CNC) system for effecting a finishing treatment of a surface, the system comprising:

(a) a mechanical assembly including:

at least one mechanical arm, adapted to move within at least two controllable axes of motion;

a shoe arrangement, adapted to connect to an end of said arm and having at least one flexible surface finishing pad, said pad having a working surface having a diameter (D); and a drive mechanism adapted to drive said arm;

(b) a controller;

(c) a communication arrangement adapted to deliver communication signals between said controller and said mechanical assembly; and (d) a positioning system providing said controller with positioning information with respect to said mechanical assembly, the system configured whereby said arm is responsive to said controller, said mechanical assembly adapted to urge said working surface against a workpiece surface, whereby a pressure is delivered thereto, and wherein a dimensionless ratio defined by said diameter (D) divided by a length of mechanical deformation ($L_{def}$) of said surface finishing pad, normal to said working surface, fulfills at least one of the following structural criteria:

($D/L_{def}$) falls within a range of 2-120 for said pressure within a range of 0.05-1 bar;

($D/L_{def}$) falls within a range of 4-180 for said pressure within a range of 0.5-2 bar;

($D/L_{def}$) falls within a range of 6-200 for said pressure within a range of 1-3 bar;

($D/L_{def}$) falls within a range of 8-250 for said pressure within a range of 2-6 bar; and ($D/L_{def}$) falls within a range of 12-450 for said pressure within a range of 3-20 bar.

2. The system of claim 1, wherein said shoe arrangement includes a compressible shaft, and wherein said shaft is adapted to contribute at least 25% of an overall mechanical compliance of said assembly, normal to said working surface.

3. The system of claim 2, wherein said shaft contributes at least 50% of said overall mechanical compliance.

4. The system of claim 1, wherein a ratio of a contribution of said shaft to said compliance to a contribution of said finishing pad to an overall mechanical compliance of said assembly, normal to said working surface, is at least 0.33.

5. The system of claim 1, wherein said shoe arrangement includes a finishing tool having at least one spring arrangement, said spring arrangement disposed and adapted to contribute to an overall mechanical compliance of said assembly, normal to said working surface.

6. The system of claim 1, wherein said finishing pad includes at least one groove disposed in said working surface, said at least one groove adapted, whereby, during a finishing operation on said workpiece surface, an abrasive paste disposed on said workpiece surface, around said finishing pad, is delivered, via said at least one groove, to an active contacting surface of said working surface.

7. The system of claim 6, wherein said grooves divide said working surface into a plurality of segments.

8. The system of claim 1, wherein said shoe arrangement includes a support layer adapted to support said pad, said support layer having a flexibility exceeding a flexibility of said pad.

9. The system of claim 1, wherein said finishing pad includes at least one groove disposed in said working surface, said shoe arrangement includes a support layer adapted to support said pad, and said at least one groove is disposed passes through said pad and at least partway through said support layer.

10. The system of claim 1, wherein said shoe arrangement includes a holder adapted to hold said pad.

11. The system of claim 1, wherein said controller is adapted to control an overall mechanical compliance of said assembly.

12. The system of claim 1, wherein said controller is adapted to control an overall mechanical compliance to maintain said pressure within a pre-determined range, or to constrain said pressure to a set point.

13. The system of claim 1, wherein said mechanical assembly includes at least one spring arrangement disposed and adapted to contribute to an overall mechanical compliance of said assembly, said spring arrangement responsive to said controller.

14. The system of claim 1, wherein said mechanical assembly includes at least one controllable spring arrangement disposed and adapted to contribute to said overall mechanical compliance, said spring arrangement responsive to said controller, and wherein said controller is adapted to control said spring arrangement to maintain said pressure within a predetermined range, or to constrain said pressure to a set point.

15. The system of claim 13, wherein said controller is adapted to control said overall mechanical compliance by control of an internal pressure within said mechanical assembly.

16. The system of claim 15, wherein said internal pressure is a pneumatic pressure or a hydraulic pressure.

17. The system of claim 13, wherein said working surface of said finishing tool is a polymeric working surface.

18. The system of claim 13, wherein said at least one mechanical arm is a plurality of mechanical arms, and wherein said drive mechanism is adapted to drive said plurality of arms.

19. The system of claim 13, wherein said drive mechanism includes a main rotating shaft adapted to rotate said plurality of mechanical arms.

* * * * *